US005242732A

United States Patent [19]

Bahakel

[11] Patent Number: 5,242,732

[45] Date of Patent: Sep. 7, 1993

[54] FINISHING BOARD

[76] Inventor: Jim Bahakel, 403 22nd Ave. S., Birmingham, Ala. 35205

[21] Appl. No.: 397,953

[22] Filed: Sep. 27, 1989

[51] Int. Cl.[5] ..... B44C 7/02

[52] U.S. Cl. ..... 428/81; D8/45; 52/DIG. 1; 428/904.4

[58] Field of Search ..... 428/904.4, 81; 52/DIG. 1; 15/236.02; 156/576, 71; 294/7; D8/45; D32/46

[56] References Cited

U.S. PATENT DOCUMENTS

| | | | |
|---|---|---|---|
| 2,354,857 | 8/1944 | Gits et al. | 428/187 X |
| 2,519,946 | 8/1950 | Voelker et al. | 30/169 X |
| 3,408,677 | 11/1968 | Yates | 15/236.02 |
| 3,947,992 | 4/1976 | Lemelson | 428/38 X |
| 3,952,423 | 4/1976 | Gentry | 434/245 |
| 4,054,000 | 10/1977 | Lisle | 428/15 X |
| 4,199,173 | 4/1980 | Greenlees | 24/457 X |
| 4,456,261 | 6/1984 | Daitzman | 273/271 |
| 4,626,454 | 12/1986 | Sandman | 428/13 |

*Primary Examiner*—Henry F. Epstein
*Attorney, Agent, or Firm*—Hopkins & Thomas

[57] ABSTRACT

A finishing board provides a smooth finish and removes air pockets during the application of wall coverings. A substantially rectangular plastic board has four rounded edges, four rounded corners, and a thickness of approximately ⅛ of an inch. A first edge is configured to contact a wall covering and measures either about 8 inches in a first embodiment or 12 inches in a second embodiment. A second edge is situated parallel to the first edge and also measures either about 8 inches in the first embodiment or about 12 inches in the second embodiment. A third edge connects and is orthogonal to the first and second edges. The third edge measures about 5 inches. A fourth edge is situated parallel to the third edge and connects the first and second edges. The fourth edge also measures about 5 inches. All of the edges are rounded to exhibit a 1/16 inch radius. Moreover, all of the corners are rounded to exhibit an ⅛ inch radius.

6 Claims, 1 Drawing Sheet

FINISHING BOARD

FIELD OF THE INVENTION

The present invention relates to finishing boards or hand-held boards used in the application and finishing of wall coverings.

BACKGROUND OF THE INVENTION

In the art, the application and finishing of wall coverings involves the use of a broad knife, which consists of a flat, sharp piece of metal with a handle at one end. The broad knife is pressed or drug across various types of wall coverings and finishes in order to smooth the wall coverings and finishes. Oftentimes, as the broad knife is moved across the wall, damage results to the wall covering if the user is not extremely careful. The problem with the present state of the art is that most broad knives are made of metal and utilize a sharp edge in the area of the contact surface. This sharp edge requires the user to push or pull the broad knife across the areas being worked on in a single linear direction. If the user were to change the path of the broad knife during motion, this action would result in tearing and/or damage to the wall or wall covering. To further complicate matters, it is common for air pockets to form during the normal application of wall coverings.

Accordingly, an object of the present invention is to provide a finishing board which can be used to apply wall coverings in nonlinear paths without fear of damaging the wall covering.

Another object of the present invention is to provide a finishing board which minimizes air pockets in the applied wall covering.

Another object of the present invention is to provide a finishing board which is simple in design, inexpensive, and easy to use.

SUMMARY OF THE INVENTION

The present invention is a novel finishing board for providing a smooth finish and for removing air pockets during the application of wall coverings. In accordance with the present invention, the finishing board has a substantially rectangular plastic board with four edges, four corners, and a thickness of approximately ⅛ inch. A first edge is configured to contact a wall covering and measures either about 8 inches in a first embodiment or about 12 inches in a second embodiment. A second edge is situated parallel to the first edge and measures either about 8 inches in the first embodiment or about 12 inches in the second embodiment. A third edge is situated orthogonally between the first and second edges and measures about 5 inches. A fourth edge is situated parallel to the third edge and between the first and second edges. The fourth edge also measures about 5 inches.

In accordance with a significant feature of the present invention, the edges are rounded to exhibit a 1/16 inch radius, and the corners are rounded to exhibit a ⅛ inch radius. As a result, an appropriate pressure may be applied by the hand of a user so as not to undesirably damage the wall or wall covering during application of the wall covering.

Preferably, the novel finishing board is made of an acrylic plexiglass material. The acrylic plexiglass material is advantageous because it is stiff enough and thick enough to withstand the applied pressure against the wall, yet is capable of bending to provide the proper angle for wall contact and for effectively removing air pockets. Hence, a smooth finish on the wall can be achieved in accordance with the present invention.

Other objects, features, and advantages of the present invention will become apparent from the following description when considered in conjunction with the accompanying drawings.

BRIEF DESCRIPTION OF THE DRAWINGS

The present invention, as defined in the claims, can be better understood with reference to the following drawings. The drawings are not necessarily to scale, emphasis instead being placed upon clearly illustrating principles of the present invention.

DETAILED DESCRIPTION OF THE PREFERRED EMBODIMENTS

Figure 1:
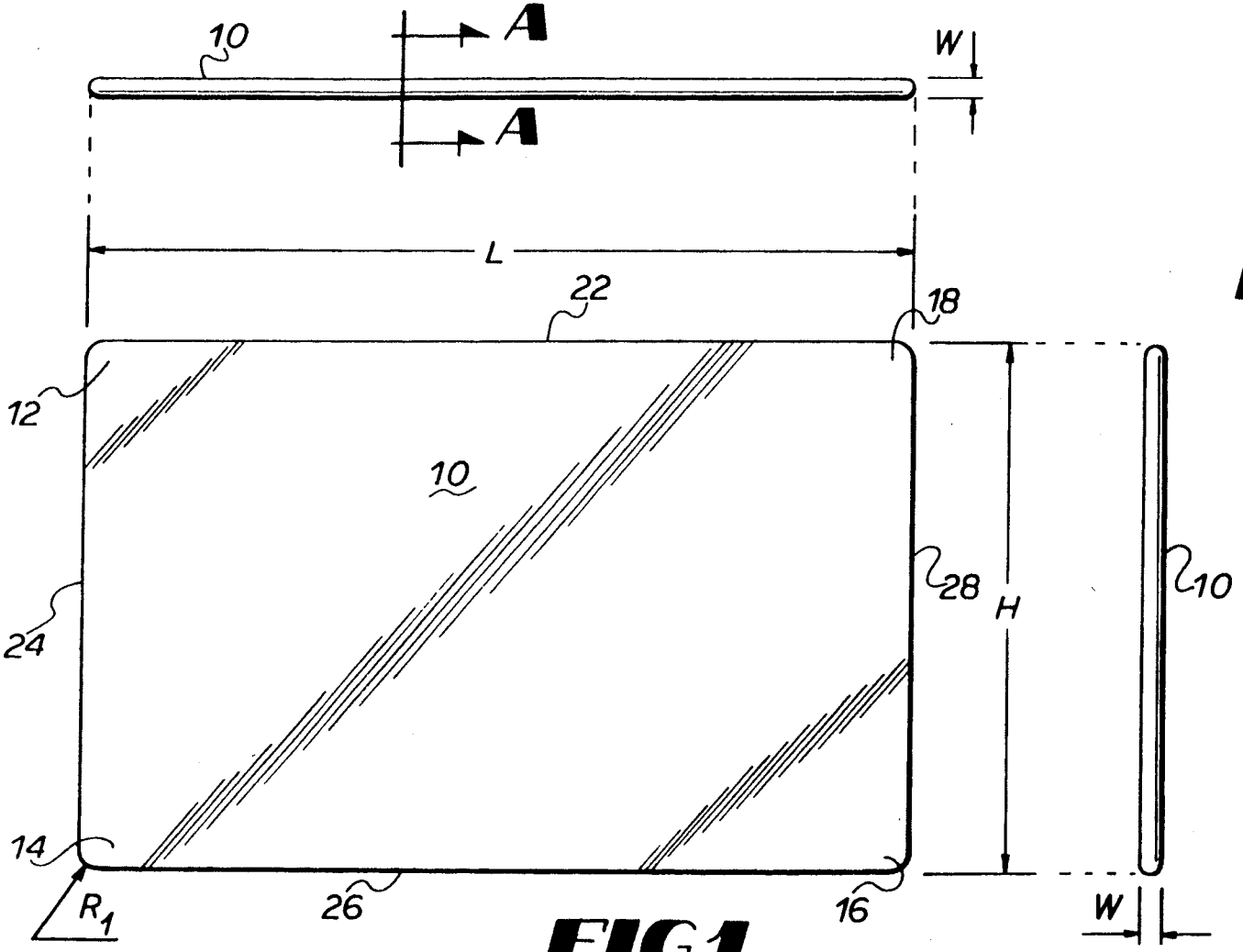
FIG. 1 shows a plan view of the finishing board in accordance with the present invention.

Referring now in detail to the preferred embodiments chosen for the purpose of illustrating the present invention, FIG. 1 shows a plan view of a substantially rectangular finishing board 10 in accordance with the present invention. The finishing board 10 has four rounded corners 12, 14, 16 and 18, four rounded edges 22–28, and a thickness of about ⅛ inch. A first edge 22 is configured to directly contact a wall covering on a wall surface. The first edge 22 has a length L of either 8 or 12 inches in the preferred embodiment. A second edge 26 is situated parallel to the first edge 22 and measures approximately the length L. A third edge 24 is situated orthogonally to the first and second edges 22, 26, as shown. The third edge 24 measures a height H. A fourth edge 28 is also situated parallel to the third edge 24, which is orthogonal to the first and second edges 22, 26.

Figure 2:
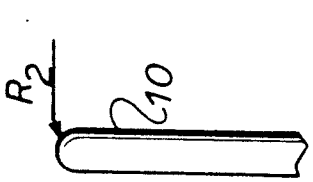
FIG. 2 illustrates an exploded cross-sectional view of the finishing board of FIG. 1 taken along line A—A.

In accordance with a significant aspect of the present invention, the corners 12–18 of the finishing board 10 are rounded to exhibit a corner radius $R_1$. Moreover, the edges 22–28 are rounded to exhibit a edge radius $R_2$, as shown in FIG. 2.

In a first embodiment of the present invention, length L measures about 8 inches, height H measures about 5 inches, corner radius $R_1$ is about ⅛ inch, and edge radius $R_2$ is about 1/16 inch.

In a second embodiment of the present invention, length L measures about 12 inches, height H measures about 5 inches, corner radius $R_1$ is about ⅛ inch, and edge radius $R_2$ is about 1/16 inch.

Preferably, the finishing board 10 is manufactured from a plastic, such as an acrylic plexiglass material or other similar material. The acrylic plexiglass material provides for light weight and resilience necessary for proper utilization. Pressure can easily be applied by a user to the finishing board against a wall covering and any air pockets are removed and a smooth finish is obtained.

It will be apparent to those skilled in the art that numerous modifications may be made to the preferred embodiments without departing from the spirit and scope of the present invention. All such modifications are intended to incorporated within the scope of the present invention as defined hereinafter in the claims.

What is claimed is:

1. A finishing apparatus for providing a smooth finish and for removing air pockets during the application of wall coverings, comprising:

a substantially rectangular plastic board means having four edges, four corners, and a thickness of about ⅛ inches;

said edges having a first edge configured to contact a wall covering and measuring about 8 inches, a second edge parallel to said first edge and measuring about 8 inches, a third edge connecting and orthogonal to said first and second edges and measuring about 5 inches, and a fourth edge parallel to said third edge and connecting said first and second edges and measuring about 5 inches;

said edges being rounded to exhibit a 1/16 inch radius;

said corners being rounded to exhibit a ⅛ inch radius; and said board means being for moving across a wall in a path under pressure to remove air pockets in said wall covering.

2. The finishing apparatus of claim 1, wherein said plastic board means comprises an acrylic resin.

3. A finishing apparatus for providing a smooth finish and for removing air pockets during the application of wall coverings, comprising:

a substantially rectangular plastic board means having four edges, four corners, and a thickness of about ⅛ inches;

said edges having a first edge configured to contact a wall covering and measuring about 12 inches, a second edge parallel to said first edge and measuring about 12 inches, a third edge connecting and orthogonal to said first and second edges and measuring about 5 inches, and a fourth edge parallel to said third edge and connecting said first and second edges and measuring about 5 inches;

said edges being rounded to exhibit a 1/16 inch radius;

said corners being rounded to exhibit ⅛ inch radius; and said board means being for moving across a wall in a path under pressure to remove air pockets in said wall covering.

4. The finishing apparatus of claim 3, wherein said plastic board means comprises an acrylic resin.

5. A finishing apparatus for providing a smooth finish and for removing air pockets during the application of wall coverings, comprising:

a substantially rectangular plastic board having four edges, four corners, and a thickness of about ⅛ inch;

said edges having a first edge configured to contact a wall covering, a second edge parallel to said first edge, said first and second edges both measuring either 8 or 12 inches, a third edge connected and orthogonal to said first and second edges and measuring about 5 inches, and a fourth edge parallel to said third edge and connecting said first and second edges and measuring about 5 inches;

said edges being rounded to exhibit a 1/16 inch radius; and said corners being rounded to exhibit a ⅛ inch radius;

whereby said board is configured to move across a wall in a path under pressure to remove air pockets in said wall covering.

6. The finishing apparatus of claim 5, wherein said plastic board comprises an acrylic resin.

* * * * *